US006017636A

United States Patent [19]

Tada et al.

[11] Patent Number: 6,017,636

[45] Date of Patent: Jan. 25, 2000

[54] TRANSFER SYSTEM AND TRANSFER METHOD THEREOF

[75] Inventors: Junji Tada; Keiichi Nakatani; Shinjirou Iguchi, all of Kyoto, Japan

[73] Assignee: Shinzen Co., Ltd., Kyoto, Japan

[21] Appl. No.: 08/842,078

[22] Filed: Apr. 28, 1997

[30] Foreign Application Priority Data

| | | | |
|---|---|---|---|
| Apr. 26, 1996 | [JP] | Japan | 8-131306 |
| Nov. 27, 1996 | [JP] | Japan | 8-353849 |
| Mar. 24, 1997 | [JP] | Japan | 9-090282 |

[51] Int. Cl.[7] ..... B41M 5/30; B41M 5/40

[52] U.S. Cl. ..... 428/423.1; 428/195; 428/212; 428/325; 428/413; 428/447; 428/500; 428/913; 428/914

[58] Field of Search ..... 428/195, 423.1, 428/500, 212, 913, 914, 323, 325, 413, 447

[56] References Cited

U.S. PATENT DOCUMENTS 5,223,328 6/1993 Ito et al. ..... 428/195

FOREIGN PATENT DOCUMENTS 60-92897 5/1985 Japan .
1-287183 11/1989 Japan .
4-361086 12/1992 Japan .
5-179578 7/1993 Japan .
6-308779 11/1994 Japan .
7-214889 8/1995 Japan .
8-252967 10/1996 Japan .
8-305064 11/1996 Japan .

*Primary Examiner*—Bruce H. Hess
*Attorney, Agent, or Firm*—Kubovcik & Kubovcik

[57] ABSTRACT

A transfer system and transfer method are provided. The transfer system includes one or two transfer sheets. The first transfer sheet has a transfer layer of an aqueous urethane emulsion which, in preferred embodiments, is a layer formed from an emulsion of a urethane resin having carboxy groups and/or an acrylic resin. The second transfer sheet typically includes two transfer layers of a urethane resin and/or acrylic resin, one of the layers containing an inorganic pigment or a metal powder. Images formed on one of the transfer sheets by electrostatic copying or by other means such as hand-drawing can be transferred to various objects including fabrics, glass plates, and metal surfaces to provide clear and decorative images having good abrasion- and water-resistance.

24 Claims, 3 Drawing Sheets

TRANSFER SYSTEM AND TRANSFER METHOD THEREOF

FIELD OF THE INVENTION

The present invention relates to a transfer system, for example, a transfer sheet, or a combination of transfer sheets, for transferring an image, which may be created by an image forming apparatus such as an electrostatic copier, or which may be formed by hand-drawing pictures, letters and patterns, to another medium.

The present invention also relates to a method for transferring an image using the transfer system.

BACKGROUND OF THE INVENTION

A method is known for transferring an image using a transfer sheet having a heat-adhering resin layer coated on a surface of a releasing sheet, in which an image is provided on the heat-adhering resin layer, the heat-adhering layer is placed on the surface of an object, or receiver, such as a fabric, leather or the like onto which the image is to be transferred, the transfer sheet is heat-pressed against the object and the releasing sheet is removed.

Such a conventional transfer sheet has a heat-adhering resin coating layer, for example, a heat-elastic resin such as urethane resin, provided on a surface of a releasing sheet. However, the urethane resin is usually a solvent-type urethane resin having a low softening point, usually less than 100° C. When the transfer sheet is heated and pressed to transfer the image onto the surface of an object, the resin softens or becomes liquid and the image layer submerges into the liquid and becomes blurred. This phenomena makes it difficult to transfer clear or fine images onto the surface of an object. It is also impossible to transfer a bright image onto a colored substrate such as a dark fabric or onto knitted materials, because the transfer layer does not have a sufficient hiding property.

There is also a problem of poor resistance to washing and tumbling (i.e., resistance to surface friction for tumble-type washing machines and dryers) in products having a transferred image formed by the conventional transfer sheet.

OBJECTS OF THE INVENTION

An object of the present invention is to provide a transfer system for transferring a clear image onto an object even if the image is bright, or even if the object is dark or made of a knitted material.

Another object of the present invention is to provide a transfer system and method which can transfer an image to the surface of an object, which image has a high resistance to washing and tumble drying.

A further object of the invention is to provide a transferred image having improved adhesion to an object.

A still further object of the present invention is to provide a transfer system that reduces environmental problems and the risk of fire which are caused by the use of organic solvents during the manufacture of a transfer sheet.

A further object of the present invention is to impart a water-resistant property to the surface of a transferred image.

An even further object of the present invention is to provide a simple method for manufacturing a transfer medium.

SUMMARY OF THE INVENTION

The present invention solves the problems described above and achieves the foregoing and other objectives and provides an improved transfer system and transfer method and an improved transferred image.

The improved transfer system according to the present invention in a first embodiment comprises a first transfer sheet having a releasing substrate and a transfer layer of an emulsion type urethane resin which preferably contains a ceramic micro-powder.

The transfer system of the present invention in a second embodiment comprises a combination of a first transfer sheet having a transfer layer of an emulsion type urethane resin provided on a releasing substrate and a second transfer sheet having lower, intermediate and upper layers laminated on a releasing substrate, at least the upper layer containing a pigment or metallic powder and being an emulsion-type urethane resin, the lower layer being a heat-adhering resin layer containing an aromatic hydrocarbon having a group or groups containing -OH and the intermediate layer being an organic resin that keeps the upper and lower layers adhered together.

The improved transfer system according to the present invention in a third embodiment comprises a transfer sheet having a releasing substrate, and a transfer layer of an emulsion-type urethane resin having carboxyl groups and/or of an acrylic resin and provided on the substrate.

In a fourth embodiment, the transfer system of the present invention comprises a first transfer sheet having a layer of an emulsion-type urethane resin having carboxyl groups and/or an acrylic resin provided on a releasing substrate, and a second transfer sheet having a lower layer of an emulsion-type urethane resin which contains carboxyl groups and/or an acrylic resin provided on a releasing substrate, the lower layer containing or not containing an inorganic filler, and a top layer of an emulsion-type urethane resin having carboxyl groups and/or an acrylic resin provided on the lower layer and not containing an inorganic filler.

In a fifth embodiment of the transfer system of the present invention, the system comprises a first transfer sheet having a layer of an emulsion-type urethane resin having carboxy groups and/or an acrylic resin provided on a releasing substrate, and a second transfer sheet comprising a lower layer of an emulsion-type urethane resin having carboxyl groups and/or an acrylic resin provided on a releasing substrate, and not containing an inorganic filler and a top layer of an emulsion-type urethane resin having carboxyl groups and/or an acrylic resin provided on said first layer, said top layer containing or not containing an inorganic filler.

In preferred transfer systems of the present invention the urethane resin and acrylic resin of a transfer sheet are in the form of an hydroxylamine salt thereof.

In other preferred transfer systems of the present invention the urethane resin and acrylic resin layer of a transfer sheet include an organic silicone compound and/or include an epoxy or isocyanate cross-linking agent.

In preferred transfer sheets of the present invention, the releasing substrate is a paper having a back surface coated with a water insoluble polymer resin such as an acrylic-urethane resin.

In a first embodiment of a transfer method according to the present invention the first embodiment is prepared by forming a layer of an emulsion-type urethane resin on a releasing substrate, an image (or picture) layer is formed on the layer of urethane resin, the image surface of the transfer sheet is placed on a surface of an object to which the image is to be transferred, the transfer sheet is heat-pressed against the object and, thereafter, the releasing substrate is removed.

In a second embodiment of the transfer method according to the present invention, the second embodiment transfer system of the present invention is used. The first and second transfer sheets are prepared. The resin surfaces of the transfer sheets are placed in face-to-face contact and heat-pressed together to form a unitary body. The releasing substrate of the second transfer sheet is peeled away to expose the layer of heat-adhering resin. The heat-adhering resin surface is contacted with and heat-pressed against the surface of an object to which an image is to be transferred. After heat-pressing the releasing substrate of the first transfer sheet is removed to give the object having the transferred image layer.

In a third embodiment of the transfer method according to the present invention, the third embodiment of the transfer system is used. According to this embodiment of the method, a transfer sheet is prepared by forming one or more layers of an emulsion-type urethane resin having carboxyl groups and/or an acrylic resin on a surface of a releasing substrate, an image (or picture) layer is formed on a surface of said urethane and/or acrylic resin, the image surface of the transfer sheet is placed on a surface of an object to which the image layer is to be transferred, the transfer sheet is heat-pressed against said object and, thereafter, the releasing sheet is removed.

In a fourth embodiment of a transfer method according to the present invention, the fourth embodiment of the transfer system of the present invention comprising two transfer sheets is used. The first transfer sheet includes a layer of an emulsion-type urethane resin having carboxyl groups and/or an acrylic resin adhered to a releasing substrate. The second transfer sheet includes a lower layer of an emulsion-type urethane resin having carboxyl groups and/or an acrylic resin on a releasing substrate, the lower layer containing or not containing an inorganic filler, and a top layer of an emulsion-type urethane resin having carboxyl groups and/or an acrylic resin provided on the lower layer and not containing an inorganic filler. An image layer is formed on the upper surface of the first transfer sheet or on the upper surface of the second transfer sheet. The upper surfaces of the transfer sheets are placed against each other and the two sheets are heat-pressed together to form one body. One of the releasing substrates is removed and the exposed surface is placed against the surface of an appropriate object to which the image layer is to be transferred. The body is heat-pressed against the object and after heat-pressing, the remaining releasing substrate is removed.

In a further embodiment of the transfer method of the present invention using the fifth embodiment of the transfer system comprising two transfer sheets, the lower layer of the second transfer sheet does not contain a filler whereas the upper layer contains or does not contain a filler. The upper surfaces of the two sheets are heat-pressed together and, after removing one of the releasing sheets, the exposed layer of the resultant body is heat-pressed against the surface of an object to which the image layer is to be transferred. After heat-pressing the other releasing substrate is removed.

In the various embodiments of the transfer sheet according to the present invention, the layer of urethane resin having carboxyl groups is preferably formed using an emulsion type, non-yellowing urethane resin obtained by a water extension reaction and emulsification after neutralization of a urethane prepolymer with a tertiary amine. Similarly, the acrylic resin is preferably formed from an aqueous emulsion.

DESCRIPTION OF PREFERRED EMBODIMENTS

As the releasing substrate (sometimes referred to hereinafter simply as a releasing, or releasable, sheet) having a releasing layer used in the transfer system of the present invention, all types of thin film substances having appropriate releasing properties can be used. These thin film substances include papers, synthetic papers and plastic films. As the releasing layer, fluorine resins, wax and silicone resins are typically used. From an economical standpoint, silicone resins are recommendable, and a conventional silicone releasing paper can be used.

Generally, papers surface-coated with talc and/or starch for sealing one or both sides of the paper and having a weight of more than 30 g/m$^2$ and less than 200 g/m$^2$ are used.

Also, since an aqueous resin emulsion is typically applied to the releasing sheet to form said layer of urethane resin and/or acrylic resin, the back surface of the releasing sheet is preferably coated with a resin to prevent the sheet from developing folds or curling when it is allowed to stand at room temperature and to avoid problems when the transfer sheet is passed through an electrostatic copier (sometimes referred to hereinafter as an electro photo machine or electrophotographic machine). An acrylic-urethane resin as described hereinafter or the like is typically used as a resin to coat the back surface of the releasing sheet.

The first and second embodiments of the transfer system of the present invention and the first and second embodiments of the transfer method of the present invention will now be described with reference to the drawings.

Figure 1A:
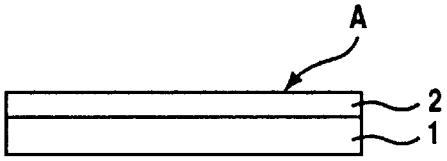
FIGS. 1(*a*), (*b*) and 2–4 illustrate the transfer method according to the present invention using the second embodiment of the transfer system of the present invention.
Figure 1B:
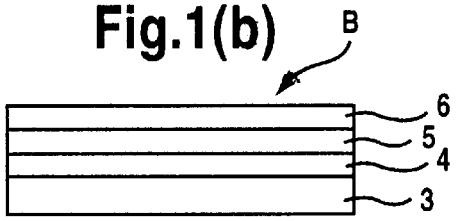

FIG. 1(*a*) shows the construction of the first transfer sheet, and FIG. 1(*b*) shows the construction of the second transfer sheet that is used with the first transfer sheet of the second embodiment of the transfer system of the present invention.

As shown in FIG. 1(*a*), the first transfer sheet A of the present invention has a layered structure (coated) having a urethane emulsion resin layer 2 containing a ceramic micro powder on the surface of a releasing sheet 1 having a releasing property. Regarding the particle size of the ceramic powder, the range of the size is preferably between 0.1 and 13 $\mu$m, and more preferably, between 3 and 7 $\mu$m, and particles of more than two sizes can be used.

The used amount of the ceramic powder is preferably 1 to 20, and more preferably, 2 to 10 weight parts (i.e., parts by weight) for 100 weight parts of the solid resin. In the present invention, micro-powder silica, calcium carbonate and the like can be used as the ceramic powder, and an inactive type of ceramic powder having no influence on the physical properties of the resin is preferred. The micro-powder silica is most preferred from the standpoints of friction resistance and tack-prevention.

The resin composing the urethane emulsion resin layer 2 preferably has a softening point higher than 120° C. and an elongation of more than 300% and has a property of adhering to a body on heat-pressing (hot lamination property). A urethane resin of the water-solubilization type is preferred. The commercially available products of the resin solution used for the formation of the urethane emulsion resin layer are, for example, Impranil Dispersion DLH, 85UD (trade name) and the like. Urethane emulsion resins having a softening point of 140 to 220° C. are especially preferred. In the case of a resin having a softening point of lower than 120° C., the resin becomes liquid during heat-pressing and the image formed with a toner layer is influenced. An elongation of 300 to 700% of the urethane of the urethane emulsion resin is preferred. In the case of an elongation of less than 300%, the feel of the product to be transferred becomes bad, and cracking of the resin is observed.

The urethane emulsion layer 2 can be formed by coating and drying with a coating solution which is obtained by adding ceramic micro-powder, a viscosity increasing agent, a defoamer and the like to the water-solubilization type of urethane resin solution.

In the present invention, the use of a urethane emulsion resin having the specific softening point and elongation is able to prevent the flow of a toner layer during adhesion of the transfer sheets and during heat-transferring. A toner image layer formed by an electro photo means can be transferred to an object surface in a clear state.

The film thickness of the urethane emulsion resin layer 2 of the first transfer sheet A is preferably 5 to 20 μm. A thickness of about 10 μm is most preferred. When the thickness is less than 5 μm, film strength, adhesion, resistance to washing and resistance to tumbling become bad, and the resin layer can be damaged. Conversely, when the thickness is greater than 20 μm, a product having good feel can not be obtained. In order to form a urethane emulsion layer 2 having an appropriate film thickness, various kinds of coating machines, for example, a roll coater, knife coater, gravure coater and the like can be used. A silk screen printing machine is most preferred because a layer in which a ceramic micro powder is uniformly dispersed can be obtained. To make the viscosity of the coating solution adequate for silk screen printing, an acrylic emulsion is generally added as a viscosity increasing agent to the urethane resin emulsion.

In this case, it is preferred that a silicone defoamer is added to the coating solution beforehand, in order to prevent air bubbles in the layer. Anti-static agents are added to decrease surface intrinsic electric resistance, and a surface active agent is added to improve the wetting property to the releasing sheet 1.

The releasing sheet 1 of the first transfer sheet A is a sheet material provided with a releasing agent on at least one side, and the substance properties are not otherwise particularly limited. Any of the releasing sheets on the market based on paper or plastic film can be used. In a case in which paper is used as the releasing sheet 1, it is preferred that a resin layer of an acrylic acid ester copolymer or acrylic urethane resin is provided on the surface opposite to the surface having the releasing layer in order to prevent paper curling.

As shown in FIG. 1(*b*), the second transfer sheet B has a layered structure consisting of a lower layer 4, a middle layer 5 and an upper layer 6 provided successively on a surface of a releasing sheet 3. Among them at least the upper layer 6 is a colored heat-adhering resin layer containing at least one kind of pigment or metal micro-powder. However, in the present invention the middle layer 5 and/or the lowest layer 4 may also contain one kind of pigment or metal micro-powder so far as the adhesion strength among the lower layer 4, the middle layer 5 and the upper layer 6 and the adhesion strength between the lower layer 4 and the object surface are not adversely affected. As the pigments to be contained in the second transfer sheet B of the present invention, white pigments such as titanium oxide, various kinds of colored pigments, and paste titanium oxide on the market (kneaded titanium) can be used. As the metal micro-powder, various kinds of golden powder and silver powder having an average particle size of 0.2 to 50 μm, for example, west golden powder, anti-corrosion west golden powder, yersi, aluminum flake, chemical foil, SC powder, aluminum powder, pearl powder, AG powder, DAIYOU-SHOW, gold-silver mud, and gold-silver paste and the like can be used. A mixture of more than two kinds can be used.

In the case of formulating the upper layer 6 with a pigment and/or a metal powder such as titanium powder, golden powder and aluminum powder, 10 to 300 weight parts may be combined with 100 weight parts of the solid resin. For printing on a deep colored object surface, 100 to 250 weight parts is preferable. In each case, transfer sheets having a white, golden and silver layer are formed. In the case of adding golden or aluminum powder, blending of different particle sizes or different color tones produces a sheet having different reflective properties. The thickness of the upper layer 6 is preferably 5 to 40 μm, and more preferably, 10 to 25 μm.

In the present invention, the above-described urethane resin emulsion can be used as the resin of the upper layer 6. In the case of the upper layer 6 containing a metal powder, the electric resistance value of the upper layer 6 becomes lower and an image layer of toner formed by an electro photo means can be formed on the surface of the upper layer 6. Thus, the second transfer sheet B of the present invention can also be used to form a picture toner layer by means of an electrophotographic means in the same way as the first transfer sheet of the present invention.

The upper layer 6 becomes the background layer for the toner image layer after heat-transfer, and the expression of a picture having bright colors for a colored object surface such as a colored cloth can be achieved by the hiding property of the upper layer 6. Especially, in the case of the upper layer 6 containing a metal powder, a product, observed as one body of an image (toner) layer on a background of metallic colors of golden, silver and the like, can be produced.

Further, the lower layer 4 of the second transfer sheet B is a heat-adhering resin layer containing an aromatic hydrocarbon having a group(s) containing -OH. These aromatic hydrocarbons are preferably benzylalcohol, 2-phenonoxyethanol, 2-benzyloxyethanol and the like. These compounds accelerate softening of the resin and penetration of the resin into the inner surface of the transfer object. From the standpoint of the adhesion acceleration effect of the heat-adhering resin to the object surface during heat-transfer, benzylalcohol is most preferred.

Further, a polyester resin can be added as a component enhancing the adhesion strength to the object surface in the lower layer 4. The thickness of the lower layer is preferably 5 to 20 μm, more preferably 10 μm, when the layer does not contain a pigment or metal powder; and preferably 5 to 40 μm, more preferably 15 to 25 μm, when the layer contains a pigment or metal powder.

The intermediate, or middle, layer 5 of the second transfer sheet of the present invention is a synthetic resin layer which functions to keep the upper layer 6 and the lower layer 4 adhered together. When the upper layer 6 contains a urethane resin emulsion and the lower layer 4 is a layer of a solvent-type urethane resin and polyester type resin, the middle layer preferably has the same resin composition as the lower layer, but is not limited.

If the middle layer 5 contains metal micro-powder, the middle layer 5 has electro-conductivity, like the upper layer 6, and the transfer sheet becomes hardly electrified.

Therefore, a brighter picture toner layer can be formed by an electrophotographic (electrostatic) means on the surface. The thickness of the middle layer 5 is preferably 5 to 40 μm, and more preferably 15 to 25 μm.

Next, the transfer method of the present invention of an image layer formed by an electrostatic means to an object surface by using the transfer system of the present invention, having the constructions shown in FIG. 1(*a*) and FIG. 1(*b*), is explained with reference to FIG. 2 to FIG. 4.

Figure 2:
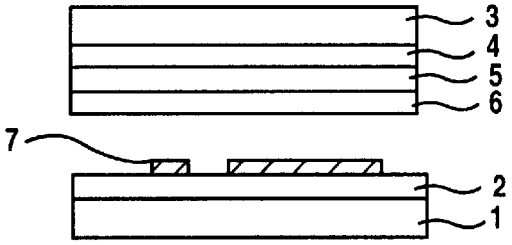

On the surface of the urethane emulsion layer 2 of the first transfer sheet of FIG. 1(*a*), an image layer 7 expressed in an inverse state is formed (refer to FIG. 2). Onto the transfer sheet, the second transfer sheet of FIG. 1(*b*) is placed, so that the urethane emulsion layer 2 is contacted with the upper layer 6 in a face-to-face relationship. These two transfer sheets are adhered to form to one body by heat-pressing with an iron having a temperature of 120 to 180° C. After cooling, the releasing sheet 3 is peeled off (refer to FIG. 3). After that, the layer (the lower layer 4) exposed by peeling is placed onto the surface of the object 8 to which the image is to be transferred, and is heat-pressed as above. Subsequently, the releasing sheet 1 is removed (refer to FIG. 4). The picture toner layer 7 expressed in a normal state is observed on the surface of the transfer object 8.

In the transfer method, as the material used to form the image layer 7, widely used black toner, and/or a color toner of yellow, cyan, fuchsin basic or the like can be used. In the present invention, the electrophotographic means used for the formation of the image layer 7 is not particularly limited, and electrostatic machines on the market can be employed.

Figure 3:
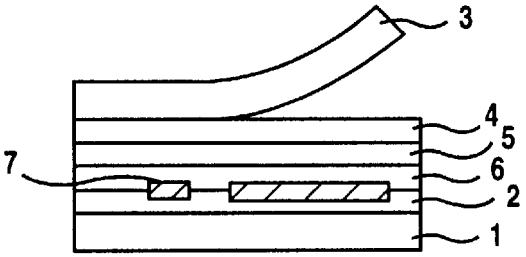
Figure 4:
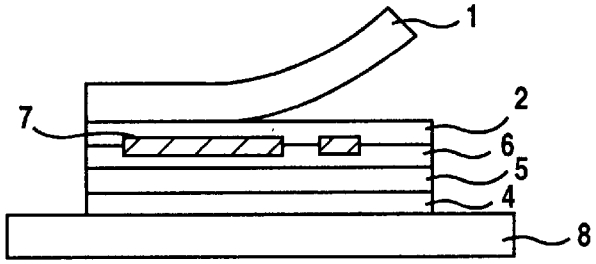

As shown in FIG. 2 to FIG. 4, the image layer 7 is formed on the first transfer sheet of FIG. 1(*a*). In the present invention, however, the image layer 7 may be formed on the second transfer sheet. In this case, the image layer 7 expressed in a normal state is formed on the surface of the upper layer 6 of the second transfer sheet by means of an electrophotographic apparatus or the like, and the steps shown in FIG. 3 and FIG. 4 are carried out.

Furthermore, in the present invention, for the adhesion of the first and the second transfer sheets to form one body, and for heat-transfer of the body to the surface of the transfer object (receiver), an industrial high pressure press machine can be used in the same way as a domestic iron. In this case, it is an advantage that the toner layer does not crack and is not submerged in the resin layer by the use of the urethane emulsion layer of the first transfer sheet which is excellent in heat-resistance.

The object 8, or receiver, to which the image layer is to be transferred by using the transfer system of the first and the second embodiments of the present invention is not particularly limited. Suitable objects include non-woven fabrics, textiles and knittings, objects of natural fibers, and a mix of natural fibers and chemical fibers, deep-colored and not-colored objects and the like. The specific objects are knittings of T-shirts, trainers, polo shirts, sweaters, jean products, dungarees, handkerchiefs, aprons, light textiles, indoor decorations, interior decorations and the like.

EXAMPLE 1

Manufacture of a First Transfer Sheet (1)

A coating solution was prepared by mixing 100 parts by weight of a urethane resin emulsion (trade name: Impranil dispersion 85UD, solids concentration 39 to 41%, manufactured by Bayer, softening point 190° C., elongation 400%), 5 parts by weight of an acrylic emulsion (trade name: Boncoat V, solids 28 to 30%, by Dai-Nippon Ink and Chemical), 3 parts by weight of 25% ammonia, 5 parts by weight of silicone defoamer and 2 parts by weight of silica micro-powder (particle size: 3 to 6 μm), until a uniform solution was obtained.

On the other hand, a releasing sheet was prepared from a releasing paper commercially available (65 g/m$^2$) coated on one surface with a releasing layer and on the opposite surface with a solution of 100 parts by weight of a copolymerization resin solution of acrylic acid ester (trade name: Cover-coat resin LO-300, solids concentration: 40 to 42%, by Goou Chem. Ind.) diluted with 20 parts by weight toluene.

The above coating solution was coated on the releasing surface of the above sheet by using silk screen printing with a 100 mesh print, and the sheet was dried at 130° C. for 10 minutes. Thus, the first transfer sheet having the construction shown in FIG. 1(*a*) was manufactured. The thickness of the resin layer was about 10 μm.

EXAMPLE 2

Manufacture of a First Transfer Sheet (2)

In place of the first urethane resin emulsion (trade name: Impranil dispersion 85 UD), 100 wt. parts of a urethane resin emulsion (trade name (Impranil dispersion DLH, solids content: 39 to 41%, of Bayer;, softening point 165° C., elongation 600%) was used. A coating solution was prepared as in Example 1. Similarly, the commercial releasing paper was coated and dried. A first transfer sheet having the construction shown in FIG. 1(*a*) was manufactured. The thickness of the resin layer thus formed was about 10 μm.

EXAMPLE 3

Manufacture of a Second Transfer (White) Sheet (1)

(1) Formation of the lower layer

A coating solution was prepared by mixing 50 parts by weight of urethane resin solution (trade name: Crysbon 4407, solids content 34 to 36%, by Dai-Nippon Ink & Chemical), 25 parts by weight of toluene, 25 parts by weight of benzylalcohol, 0.5 part by weight of silicone defoamer and 4 parts by weight of polyester resin solution (trade name: Bairon 30 ss, solids 30%, by Tohyohboh), until they become uniform.

The coating solution obtained was coated on the commercial releasing paper (65 g/m$^2$) in the same way as in Example 1, and the paper was dried at 100° C. for 10 minutes. The thickness of the lower layer was about 10 μm.

(2) Formation of the middle layer

A coating solution was prepared by mixing 50 parts by weight of urethane resin solution (trade name: Crysbon 4407), 35 parts by weight of toluene, 15 parts by weight of benzylalcohol, 50 parts by weight of titanium micro-powder (trade name: Taipeiku R-630, by Ishihara Sangyou), 0.5 part by weight of silicone defoamer and 4 parts by weight of polyester resin solution (trade name: Bairon 30 ss), until they formed a uniform coating solution. The above coating solution was coated on the lower layer formed in (1) and the paper was dried at 100° C. for 10 minutes. The thickness of the middle layer was about 20 μm.

(3) Formation of the upper layer

A coating solution was prepared by mixing 100 parts by weight of urethane resin emulsion (trade name: Impranil dispersion 85 UD), 6 parts by weight of acrylic emulsion (trade name: Boncoat V, solids 28 to 30%, by Dai-Nippon Ink and Chemical), 2 parts by weight of 25% ammonia, 5 parts by weight of silicone defoamer, and 60 parts by weight of titanium paste (trade name: kneaded titanium F2, semi-rutile titanium oxide 70%, viscosity 13000±500 cps) until they formed a uniform solution. The above coating solution was coated on the middle layer formed in (2) and the paper was dried. The second transfer sheet thus obtained has a structure as shown in FIG. 1(*b*). The thickness of the upper layer was about 20 μm.

EXAMPLE 4

Manufacture of the Second Transfer (Golden) Sheet (2)

(1) Formation of the lower layer

A coating solution having the same formulation as (1) of Example 3 was coated on the commercial releasing paper (65 g/m$^2$) and the paper was dried. A lower layer having a thickness of 10 μm was formed.

(2) Formation of the middle layer

A coating solution having the same formulation as (2) of Example 3 but using 10 parts by weight of golden powder in place of 50 parts by weight of titanium oxide was prepared and coated on the lower layer formed in (1) above. The thickness of the middle layer thus formed was about 20 μm.

(3) Formation of the upper layer

A coating solution using 100 parts by weight of urethane resin emulsion (trade name: Impranil dispersion DLH) in place of 100 parts by weight of Impranil dispersion 85 UD and 20 parts by weight of golden powder in place of the 30 parts by weight of titanium paste in (3) of Example 3 above was prepared. The thus obtained coating solution was coated on the middle layer formed in (2) above and the coated paper was dried. Thus, a second transfer sheet as shown in FIG. 1(*b*) was manufactured. The thickness of the upper layer was about 20 μm.

EXAMPLE 5

Manufacture of a Second Transfer (Silver) Sheet (3)

A silver powder was used in place of the golden powder in (2) and (3) of Example 4, and the other components were the same as in Example 4. Thus, a second transfer sheet having a structure as shown in FIG. 1(*b*) was manufactured.

In the transfer sheets of Examples 1 to 5, an image layer was formed using full color toner by an electrostatic copy machine (trade name: CLC 700, by Canon). In each of the transfer sheets, the toner was not submerged in the resin, and a bright picture was formed on the transfer sheet.

Further, using an appropriate combination of a transfer sheet formed with an image layer and a transfer sheet formed with no image layer, suitably selected as a combination of a first transfer sheet (Examples 1 and 2) and a second transfer sheet (Examples 3 to 5) of the present invention, the head-adhering layer of the first transfer sheet was placed onto the upper layer of the second transfer sheet, stacked, heat-pressed using a domestic iron having a temperature of 180° C. and adhered to form a unitary body. After cooling and, as shown in FIG. 3, after removing the releasing sheet of the second transfer sheet, the exposed layer was placed onto a deep-colored cloth (cotton cloth) and heat-pressed using an iron of the same temperature. After that, as shown in FIG. 4, the releasing sheet of the first transfer sheet was removed.

In the thus-obtained cloth products, the image layer formed by means of the electrophotographic machine has very beautiful colors without any influence of the color of the deep colored background, and the image can be expressed as clearly and brightly as the original, the feel of the cloth is satisfactory and the adhesion strength of the image layer is sufficient.

The cloth products were subjected to an anti-washing test according to JIS L 0844 A-1 washing test, and was confirmed to have a ranking of 5 (best). After washing, peeling of the image layer was not observed and the image was confirmed to be excellent in anti-tumbling property.

The second embodiment of the transfer system of the present invention and the transfer method of the present invention which uses the second embodiment of the transfer system involve the use of an organic solvent-type resin in the second transfer sheet. The transfer systems of the third, fourth and fifth embodiments of the present invention and the transfer methods employing those systems avoid the use of an organic solvent. These transfer systems and methods will now be described.

The transfer systems of the third, fourth and fifth embodiments comprise an emulsion-type urethane resin having carboxy groups and/or an acrylic resin as a transfer layer.

The urethane resin having carboxyl groups is a non-yellowing urethane resin formed from a self-emulsifiable emulsion obtained by a water extension reaction and emulsification after or during neutralization of, with tertiary amines, a urethane prepolymer obtained by reacting (I) an aliphatic and/or alicyclic diisocyanate, (II) a polyetherpolyol and/or polyesterdiol having an average molecular weight of 500 to 5,000, (III) a polyhydroxy compound of low molecular weight, and (IV) a dimethylol alkanoic acid in an NCO/OH equivalent ratio of 1.1 to 1.9. The preparation of the emulsion-type urethane resin having carboxyl groups is described in Japanese patent application No. 287183/1989, which is incorporated herein by reference. The carboxyl group joined to the urethane resin structure of the urethane emulsion is preferably in the form of an ammonium salt.

As (I), the aliphatic and/or alicyclic diisocyanates, hexamethylene diisocyanate, 2,2,4-trimethylhexane diisocyanate, 1,4-cyclohexane diisocyanate, isophorone diisocyanate (IPDI), 4,4'-dicyclohexylmethane diisocyanate, methyl cyclohexylene diisocyanate, isopropylidene dicyclohexyl-4,4'-diisocyanate and their modified compounds (modified compounds having carbodiimides, uretodiones and uretoimines) can be used.

As (II), the polyetherpolyols and/or polyesterdiols having an average molecular weight of 500 to 5,000, preferably 1,000 to 3,000, for example, products obtained by polymerization or co-polymerization reactions of alkylene oxides (ethylene oxide, propylene oxide, butylene oxide and the like) and/or heterocyclic ethers (tetrahydrofuran and the like) such as PEG (polyethyleneglycol), PPG (polypropyleneglycol), PTMG (polytetramethyleneglycol); condensation polymerization products of dicarboxylic acids (adipic acid, sebacic acid, maleic acid, fumaric acid, phthalic acid and the like) and glycols [EG (ethyleneglycol), PG (propyleneglycol), 1,4-butanediol and the like] and polylactone diols(polycaprolactonediol and the like) are suitable.

As (III), the polyhydroxy compound(s) of low molecular weight used in preparing the urethane emulsion, glycerin, pentaerithritol, 1,1,1-trimethylol propane and the glycols (average molecular weight less than 500) of the starting materials for the above polyesterdiols and their alkylene oxide (low molecular) adducts are involved.

As (IV), the dimethylol alkanoic acid(s) used in preparing the urethane emulsion used in the present invention, dimethylol acetic acid, dimethylol propionic acid, dimethylol butyric acid and the like can be used. The preferred acid is dimethylol propionic acid. The used amount of the dimethylol alkanoic acids, in terms of carboxyl groups (COOH) is 0.5 to 5.0 wt %, preferably 1 to 3 wt %, based on the weight of the prepolymer obtained by the reaction of (I) to (IV). A stable emulsion can not be obtained when the amount is less than 0.5% in terms of carboxyl groups. At a 1% level, improvements in adhesion to glass and metal surface are recognized.

But the emulsion becomes highly viscous and poor in terms of water resistance of the vehicle in the case that more than 5.0% (as carboxyl groups) is used because of the high hydrophility of the resins.

Urethane emulsions useful in the present invention are available commercially as Hydran AP and Hydran APX-100 (Dai-Nippon Ink & Chemicals) and from other sources.

Initially, almost all of the carboxyl groups joined to the urethane of the urethane emulsion in the present invention, are provided in the form of an ammonium salt. Then, a mixture of the urethane emulsion, an optional cross-linker, a hydroxylalkylamine and other additives is applied as a coating solution to the releasing sheet, and the coated sheet is dried at 70 to 130° C. The ammonia from the ammonium salt of the carboxyl group joined to the urethane resin is removed with this heat treatment. In place of the ammonia, the hydroxyalkylamine, having been formulated beforehand in the coating solution and represented by the formula (I) below, joins to a portion of the carboxyl groups through ion bonding, and function as an electric conductor by means of chemical properties.

The tertiary amine salt of the carboxyl group of the urethane resin, the former salt, before being converted to an ammonium salt can be used, as it is, under other conditions (under conditions of high temperature and high humidity, in a case where metallic fillers such as gold/silver powders are contained in the transfer layer).

The acrylic resin used in a transfer layer of the third, fourth and fifth embodiments of the transfer system of the present invention, can be used as an organic solvent solution, but is preferably used as an emulsion in which the resin is dispersed uniformly in an aqueous media. The dispersion is obtained by emulsion polymerization of an acrylic monomer in an aqueous solution of a dispersion stabilizer. As the dispersion stabilizer there can be used, for example, non-ionic surfactants such as polyoxyethylene nonylphenylether and the like, anionic surfactants such as the sulfate salts of non-ionic surfactants and water-soluble acrylic resins having an acid value of 20 to 150, and an average molecular weight of 5000 to 30000.

Suitable acrylic monomers include, for example, ester compounds obtained by the reaction between acrylic acid or methacrylic acid and monohydric alcohols having $C_1$ to $C_{20}$, e.g., methyl(meth)acrylate, ethyl(meth)acrylate, propyl (meth)acrylate, butyl(meth)acrylate, 2-ethylhexyl(meth) acrylate, and the like; the reaction products between acrylic acid or methacrylic acid and dihydric alcohols having $C_2$ to $C_{16}$, and having more than 2 polymerizable double bonds, e.g., ethyleneglycol di(meth)acrylate, 1,6-hexane di(meth) acrylate, trimethylolpropane di(meth)acrylate, allyl (meth) acrylate, trimethylolpropane tri(meth)acrylate; hydroxyl group-containing alkyl(meth)acrylates having $C_2$ to $C_{16}$ such as hydroxypropyl(meth)acrylate and the like. One or more than 2 kinds of monomers selected from the above monomers can be used.

Co-polymerizable monomers can be used together with the acrylic monomers. These copolymerizable monomers are, for example, monocarboxylic acids such as (meth) acrylic acid; dicarboxylic acids such as maleic acid, fumaric acid, itaconic acid and the like or α, β-ethylenic unsaturated carboxylic acids such as half-esters of maleic acid, fumaric acid, etc.; N-butyoxymethyl(meth)acrylamide, glycidyl (meth)acrylate, styrene, vinyl acetate and the like.

The acrylic resin emulsion of the present invention is used in a form neutralized with ammonia or tertiary amines. The acrylic resin emulsion is mainly used as a transfer layer of a transfer sheet for transferring images to an automobile car body, bicycle or ceramic tiles. Although a transfer sheet comprising an acrylic resin is not intended to be passed through an electro-photo machine, from the viewpoint of electric conductivity or surface intrinsic electric resistance rate of the sheet, the acrylic resin emulsion is preferably used in the form of a salt of a hydroxyalkylamine as described below.

The hydroxyalkylamines used especially for the salt formation of the urethane resins having carboxyl groups, are poly- or mono-(hydroxyalkyl)amines represented by the following formula (I)

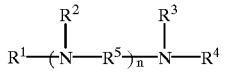

(I)

In formula (I), at least one of $R^1$, $R^2$, $R^3$ and $R^4$ is hydroxyalkyl of $C_2$ to $C_3$, and the others are alkyl, cycloalkyl and hydroxyalkoxyalkyl of $C_1$ to $C_6$; $R^5$ is alkylene of $C_2$ to $C_6$; and n is 0, 1 or 2.

The hydroxyalkyl groups are 2-hydroxyethyl or 2-hydroxypropyl. These groups attract moisture in the air in cooperation with the other amino (primary, secondary and tertiary) groups in the same molecule to provide electrical conductivity to the transfer paper. Both kinds of groups are important, and the number of the hydroxyalkyl groups and the amino groups are an important factor relating to the conductivity function.

Conceptually, these hydroxyalkylamine compounds are ethylene- or propylene-oxide adducts of alkylamines having 1 to 3 N atoms in one molecule, N-alkyl-substituted or non-substituted polyalkylene polyamines.

Mono- or poly-(hydroxyalkyl)amines having one N atom in one molecule are:

alkanolamines: monoethanolamine, diethanolamine, triethanolamine, mono-isopropanolamine, di-isopropanolamine and tri-isopropaneolamine; and N-substituted alkanolamines; N-methyl diethanolamine, N,N-dimethyl ethanolamine, N,N-diethyl ethanolamine, N-cyclohexyl diethanolamine and the like.

Mono- or poly-(hydroxyalkyl)amines having two N atoms are ethylene- or propylene-oxide adducts of ethylene diamine, for example, mono- to tetrakis-(2-hydroxy ethyl) ethylene diamine, mono- to to tetrakis-(2-hydroxy ethyl) ethylene diamine, mono- to tetrakis-(2-hydroxypropyl) ethylene diamine and the like.

Mono- or poly-(hydroxyalkyl)amines having three N atoms are ethylene- or propylene-oxide adducts of diethylene triamine, for example, mono- to penta-(2-hydroxy ethyl) diethylene triamine, mono- to penta-(2-hydroxypropyl) diethylene triamine and the like.

The most preferable are triethanolamine and tetrakis-(2-hydroxypropyl)ethylene diamine. For reference, the boiling point of triethanolamine is 360° C. (1 atmospheric pressure).

Ammonia or other tertiary amines can be used together with the above hydroxyalkylamines. These amines are, for example, trialkylamines (trimethylamine, triethylamine, tripropylamine and the like) and N-alkylmorpholines (N-methylmorpholine, N-ethylmorpholine and the like).

The used amount of the hydroxyalkylamines of the present invention is generally 0.25 to 1.5, preferably 0.7 to 1.0, equivalent for one equivalent of carboxyl.

In a preferred embodiment of the present invention, an organic silicone compound represented by the following formula (II) is used together with the urethane and/or acrylic resin:

$$X\ CH_2\ CH_2\ CH_2\ Si\ (R^6)_3 \qquad (II)$$

In formula (II), three of $R^6$ are, at the same time or independently, methoxy, ethoxy or methyl, and X is glycidylether, amino or β-aminoethylamino.

The silanol group produced by the hydrolysis of the $R^6$ alkoxy group is joined to glass by a dehydration reaction with the group Si-OH of a glass surface, and on the other hand, the functional group represented by X is joined to the resin by reaction with active hydrogens, carboxyl groups and urethane linkages. Thus, the Si compound can provide stronger bonding between the resin and glass.

These silicone compounds are γ-glycidoxypropyltrimethoxysilane, N,β-(aminoethyl)-γ-aminopropyltrimethoxysilane, N-β-(aminoethyl)-γ-aminopropyl-methyl dimethoxysilane, γ-aminopropyl triethoxysilane and the like.

The water- and chemical-resistances of the transfer layer (s) transferred to glass are greatly improved by formulating the resins with these organic silicone compounds. They are reacted to both the glass and the polymer under the conditions of heat treatment during the coating process of a transfer layer with the mixture of other chemicals, and during the transfer process to the surface of a transfer object. Generally, 0.1 to 2.0% by weight of the silicone compounds based on the resin are used.

The urethane resin and acrylic resin used as a transfer layer of the transfer sheet of the present invention can also include an epoxy or isocyanate cross linking agent. Use of these cross-linking agents improves the water- and chemical-resistance of the transferred materials.

The epoxy cross linking agents employed in the present invention, are compounds having at least two or more than two epoxy or oxirane groups, and many kinds of epoxy compounds having glycidylether or glycidylester groups. Preferred are aliphatic epoxy compounds and, most preferably, polyglycidylether compounds of water-soluble polyhydroxy compounds. For example, reaction products of epichlorohydrin with glycerin, polyglycerin, trimethylol propane, 1,6-hexane diol, neopentylglycol, ethylene glycol, propylene glycol, polyethylene (or propylene) glycol, sorbitan, sorbitol and the like can be used. They can have free hydroxyl groups. Among them, the most preferable are the reaction products of sorbitol and epichlorohydrin and sorbitol tetraglycidylether. Generally, 0.1 to 2.0% by weight of the epoxy cross-linking agents, based on the weight of the resin is used. These epoxy cross linking agents have good affinity to water and excellent compatibility with emulsion type polymers, and the epoxy groups bond to urethane- and urea-linkages and carboxyl groups and the like to improve water- and chemical-resistance.

The isocyanate cross linking agents employed in the present invention, are aliphatic or alicyclic compounds having at least two or more than two isocyanate groups, and their dimers and trimers. Generally, 0.1 to 2.0% by weight of the isocyanate cross-linking agent, based on the weight of the resin, is used.

The aliphatic or alicyclic compounds of a non-yellowing type are hexamethylene diisocyanate (HMDI), 2,2,4-trimethylhexanediisocyanate, 1,4-cyclohexane diisocyanate, isophorone diisocyanate (IPDI), 4,4'-dicyclohexylmethane diisocyanate, methylcyclohexylene diisocyanate, isopropylidene dicyclohexyl-4,4'-diisocyanate and the like. The modified products (carbodiimide, uretodione, uretoimine) of the diisocyanates of non-yellowing type are included.

Most preferable are the dimers and the trimers of biuret or isocyanurate type of HMDI or IPDI independently or as a mixture. Especially preferred are reaction products having terminal NCO groups, between (A) monohydric alcohols of methanol to isopropanol, dihydric alcohols of PEG (MW 200 to 1000) and polyhydric alcohols of glycerine, trimethylolpropane, sorbitol, triethanolamine and their ethylene oxide adducts and (B) HMDI, IPDI and their biuret—isocyanurate type trimers. The reaction products are good in compatibility with resin emulsions. Generally 0.1 to 2.0% by weight, based on the weight of the resin, of the isocyanate cross linking agent is used.

The isocyanate contributes to improve the water and chemical resistance of the transferred resin layer in the same way as the epoxy cross linking agents.

Ceramic powders can also be used with the urethane and/or acrylic resins of the transfer systems of the third, fourth and fifth embodiments of the present invention to improve adhesion and film strength, and have an advantage of making the coating solution easy to coat by adjusting the viscosity. Also, in the case of hand-drawing, the ceramic powder makes the resin paper surface easy to draw on with coloring materials such as crayons, markers and the like.

The ceramic powders useful in the resin layers of the third, fourth and fifth embodiments of the transfer systems include those used in the first and second embodiments of the transfer systems. These include colloidal silica, anhydrous micro-powder silica and the like. The particle diameter is in the range of 0.1 to 13 μm, preferably 3 to 7 μm, and more than two kinds of ceramic powders having different diameters can be mixed. The used amount of the ceramic powders is 1 to 20 weight parts, preferably 3 to 7 weight parts for 100 weight parts of the solid resin.

The method of forming the resin layer of the urethane and/or acrylic resin on the releasing sheet involves coating the urethane and/or acrylic resin emulsions or solutions on the releasing paper by using various kinds of coating machines, and drying. In such a case, the addition of a leveling agent and a defoamer is preferable, so that a uniform resin film can be formed, by avoiding mixing of air into the resin layer.

Other possible additives to the resins used in the present invention are synthetic resins such as polyvinylacetate, polyvinylchloride, EVA (ethylene vinylacetate), and the like, and their emulsions, viscosity-elasticity adjusters, viscosity increasing agents, organic and inorganic fillers, UV absorbers, hindered amines, antioxidants and the like.

In order to form a clear picture on a releasing sheet having a paper releasing substrate and for the sheet to pass through an electro-copy machine smoothly, the back surface of the transfer sheet of the present invention needs to be coated with a insoluble polymer resin such as acrylurethane resin. Because the releasing paper originally has a moisture absorption property, when a surface is coated with releasing and transfer layers, the coated surface loses the moisture absorption. On the other hand, the back is non-treated and absorbs the moisture in the air, and then the back surface swells. Because the transfer surface doe snot absorb moisture and maintains its shape whereas the back swells with moisture absorption, naturally the paper curls in. Accordingly, in order to prevent the paper from curling, it is necessary for both the transfer surface and the back to keep the same level of moisture absorption. For this purpose, the back is coated with acrylurethane resins. It is necessary for the resin to be coated on the overall back surface and to penetrate into the inner part of the paper.

The acrylic urethane resin coatings employed for the back coating of the transfer paper are two-can type coatings consisting of an acrylicpolyol (Hitaroid 3012-X manufactured by Hitachi Kasei Kogyo) and a polyisocyanate of biuret type of hexamethylene diisocyanate (Duranate 24A-100, manufactured by Asahi Chemical). It is preferred that, different from paints of polymer resins dissolved in organic solvents, after the two-can components of low molecular weight penetrate into the back sufficiently, the two-can components polymerize to form polymer resins. Curing proceeds at room temperature and is completed within two to three days.

The transfer layer of the transfer sheets of the third, fourth and fifth embodiments of the present invention consists of one resin layer or two layers. In a second transfer sheet used in a two transfer sheet embodiment of the transfer system a resin of low softening point (about 70 to 120° C.) is used as the lower layer (adhesion layer). This sheet is used for transferring to objects of textile products and coated metal surfaces (car body) of automobiles and bikes. In this transfer sheet, it is desirable that the resin of the upper layer contain fillers and have a softening point of 80 to 200° C.

In a different second transfer sheet, the lower layer contains white color fillers when the transfer object is a transparent glass panel. The resin of the lower layer is the urethane resin containing carboxyl groups and/or the acrylic resin and either or both of which includes a cross linking agent to provide improved water- and chemical resistance. As the upper layer, the said urethane and/or acrylic resins are used.

In the transfer method of the present invention, when one transfer sheet (the third embodiment of the transfer system) is used, an image layer which is provided on the transfer layer by means of an electro-photo apparatus (color-copy machine), or pictures or letters which are hand-drawn with coloring materials such as paints, markers (felt-tip pens), crayons and the like, are transferred in a reverse order in the right and left directions. There is no problem except this reversal of direction.

In the case in which the object to which the image is to be transferred is selected from general tiles, ceramic tiles and unglazed porcelain for indoor use, the surface of the transfer object is heated to a higher temperature (about 80° C. as the surface temperature) than the softening point of the resin, and then, the transfer sheet having the image layer is brought into contact with the transfer object surface. In this case, the sheet may be heat-pressed to the object by an industrial heat-press machine. After cooling, the releasing sheet is removed, and then, the product is heated again to a temperature higher than about 100° C. of the softening point of the resin. During this period, the resin penetrates into fine holes of the tile, and picture toner surface becomes flat, and a gloss appears by reason of melting of the resin. The addition of an antioxidant and UV absorber into the resin of the transfer sheet used for this purpose is recommended.

Four examples using two transfer sheets (fourth and fifth embodiments of the transfer system) are as follows:

(II-1) Two transfer sheets are prepared. The first transfer sheet is coated with the urethane resin, the second transfer sheet is coated with the acrylic resin. (Two of the first transfer sheets may be used, or two of the second transfer sheets may be used.) Two transfer sheets are placed face-to-face, stacked and heat-pressed to form one body. Then, either of the releasing sheets is removed, and the exposed surface is placed in contact with the surface of the object to which an image is to be transferred and the members are heat-pressed.

(II-2) A first transfer sheet is coated with the urethane resin or the acrylic resin, or is coated successively with the acrylic and urethane resins. A second transfer sheet having the urethane and/or acrylic resin layer in the lower (adhesion) layer and a resin layer containing organic or inorganic fillers (or not containing any fillers as the case may be) as the upper layer is prepared. Then, on the first transfer sheet an image is formed by means of an electro-photo technique, or a second transfer paper is hand-drawn with coloring materials, these two papers are placed face-to-face, stacked or otherwise disposed for heat-pressing, and heat-pressed to adhere to each other and form one body. Then, the releasing paper of the second transfer sheet is removed. After the exposed surface is placed in contact with the substrate or object surface, it is heat-pressed. After cooling, the releasing paper of the first transfer sheet is removed. Thus, the transfer of the picture is accomplished (refer to FIG. 5). In this embodiment, transfer objects are textile products, leather products, wood products, inorganic surfaces, metal surfaces and their coated surfaces and plastic surfaces and the like. Inorganic plates such as tiles, ceramic boards, china boards; metal plates such as iron, copper, aluminum and the like; and plastic plates such as polyesters, polyacrylics, PET and the like can be used. Moreover, the substrates of transfer objects can include coated metal surface such as car bodies of automobiles, motor bikes, bicycles and the like. In such a case, because the resin layer of the first transfer sheet becomes finally the most exterior layer, it is preferred that the resin layer is an acrylic resin or a cross-linked resin.

(II-3) The first transfer paper is the same as example (II-2). A second transfer paper having the urethane and/or acrylic resin layer containing an organic or inorganic filler (or not containing any filler as the case may be) in the lower layer and a transparent resin layer not containing any filler in upper layer is prepared. Then, on the first transfer paper an image layer is formed by means of an electro-photo technique, or an image layer is formed on the second transfer paper by hand drawing or other technique using coloring materials. The two sheets are placed face-to-face, stacked or layered, and heat-pressed to adhere to each other and form one body. Then, the releasing paper of the first transfer sheet is removed. After the exposed surface is placed in contact with the surface of an object substrate, they are heat-pressed. After cooling, the releasing paper of the second transfer sheet is removed. Thus, the transfer of the image is accomplished (refer to FIG. 6).

As the transfer object in this embodiment, glasses and plastics having transparency may be used. Glass is preferable. In this case, from the standpoints of safety in handling and physical strength, the use of heat-resistant and tempered glass and heat-treated glass is desirable. It is also desirable to have an embossed pattern formed uniformly over the entire surface of the back of the object substrate in order to prevent diffused reflection. A "pear skin" or similar rugged pattern is preferable.

In this embodiment, as the organic or inorganic filler contained in the lower layer of the second transfer sheet, all types of fillers as used in the upper layer of the second transfer sheet in example (II-2) can be used. Among these fillers, white pigments are especially preferred. These fillers are not limited to pure white. Colored, golden and silver coloring can be included.

Figure 7:
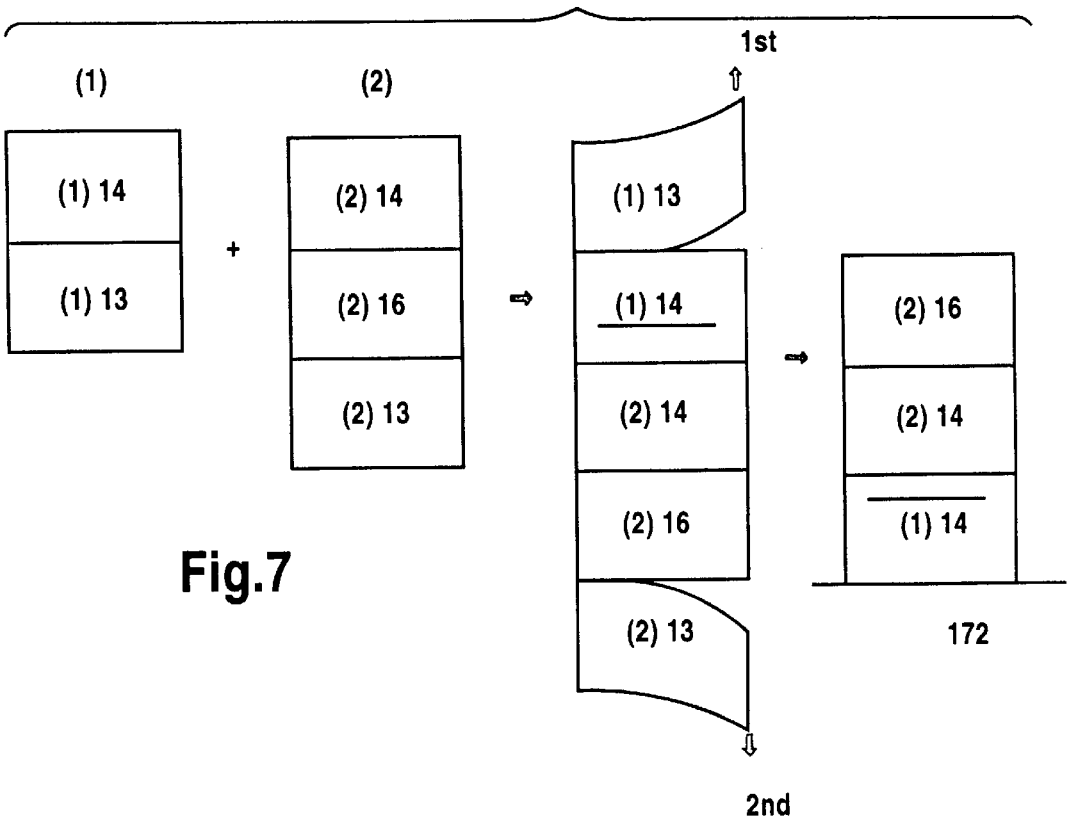

(II-4) In the case of transferring an image to bodies of automobiles, motor bikes and the like, and in the case of preparing transparent glass panels for decoration, the use of acrylic resins in the lower layer of the second transfer paper is most suitable, and the manufacturing operation is the same as in example (II-3) (refer to FIG. 7).

Layers of both urethane resins having carboxylic groups and acrylic resins in the transfer sheet of the present invention are excellent in adhesion to a silicone releasing paper and provide a tough vehicle having appropriate flexibility. These resins do not cause any difficulties such as adhering to parts of a copy machine.

In accordance with the requirements of particular applications, the urethane resin of the present invention is modified to have a high content of urethane-, carbonate-, or urea linkages, or the urethane resin is mixed with an appropriate acrylic resin for the purpose of increasing the softening point, or improving surface hardness and solvent resistance.

One type of image layer is a toner image typically formed on the first transfer sheet by means of an electrostatic copier, and is formed on the transfer layer from a toner containing dyestuffs and pigments such as carbon black, yellow, cyan, fuchsin basic and the like, in a binder resin consisting mainly of a styrene-acrylic copolymer, styrene-butadiene, an epoxy, a polyester and the like.

Another type of image layer is an image expressed as a picture or a letter hand-drawn with materials such as paints, markers (e.g., a felt-tip pen), crayons and the like, typically but not necessarily on the second transfer sheet. A human can write on the first transfer sheet, but a left-handed letter in reverse order will be expressed.

In the case of using two transfer sheets, pieces of paper such as cuttings or pictures or thin decorations such as thin cloth can be interposed between the two transfer sheets, in place of an entire or a portion of an applied image.

As mentioned previously, hydroxyalkylamines can be used in the transfer layers and function as electric conductors. In addition to the hydroxyalkylamines, other kinds of electrically conductive materials can be used. Non-ionic and/or cationic electric conductors/antistatic agents are preferred. The preferred surface intrinsic electric resistance ratio of the transfer layer is in the range of $10^8$ to $10^{13}$, preferably $10^9$ to $10^{12}$ Ω/□ under the conditions of 20° C., 65% RH.

In the transfer method of the present invention, a transfer system is placed on a transfer object, and is heat-pressed. As described below in detail, when two of the first and second transfer sheets are laminated together, various laminators (e.g., Lamipacker LPD320 by Nihon Office Laminator Co., Ltd.) can be used. In some cases, a domestic hand iron and an industrial heat-press machine can be used in the case of requiring uniform high temperatures and high pressures. The conditions of heat transfer are generally within a range of about 150 to 210° C. and more generally from 150 to 160° C. for 3 to 5 seconds using a domestic hand iron.

Also, radiation of infrared light and extreme infrared light can be utilized as a heat source.

If a two-layer transfer sheet such as that of the fifth embodiment of the transfer system is used in a one sheet method, the transfer layer of the first transfer paper of this system can be used as it is as the lower layer of the second transfer sheet. It is preferable, however, that a resin having a relatively low softening point is used from the viewpoint of adhesion to the object substrate. The upper layer of the second transfer sheet contains an organic or inorganic filler (or does not contain a filler, as the case may be). The resin in the upper layer can be the same resin as in the lower layer, but a resin having a relatively higher softening point (rich in urethane and urea linkages in the case of a urethane resin) is most preferable, in a case (A) in which the substrate is a T-shirt or thick training wear subjected to higher temperatures and mechanical shock during washing and tumble drying and in a case (B) in which the temperature of the heat-pressing of the transfer layer from the transfer sheet to a substrate surface is high. In these cases, the co-use or modification with an acrylic resin is recommended.

In the case of forming a toner image by using an electrophoto machine, because the melting point of the toner binder which comprises 90% of the toner is generally about 150° C., when a resin having a low softening point is used, the resin melts and begins to flow. The toner image becomes covered with the melted resin, and it is observed that the picture is buried and submerged. Therefore, a resin having a higher softening point is preferable. This principle is important especially in the cases of (A) and (B), and also applies to the transfer layer of the first transfer sheet.

In this case, the softening point of the urethane resin having a higher softening point is preferably higher than 150° C. and lower than 200° C.

For the purpose of raising the softening point of the urethane resins, in order to increase the contents of urethane and urea linkages, in the reaction to form the urethane prepolymer the amount of (II) the polyether- and polyester-diol is decreased, and the used amount of (III) the low molecular weight polyhydroxy compound is increased, maintaining the NCO/OH equivalent ratio, and further tri-functional polyols such as 1,1,1-trimethylol propane and the like can also be used. Furthermore, the water-extension reaction of the terminal NCO prepolymers having a high content of NCO and the introduction of carbonate linkages are considered. With the increase in the softening point, the solvent resistance may also be improved.

The fillers used in the second transfer sheet are pigments and micro-fine metal powders, and white pigments such as titanium oxide, paste titanium oxide (kneaded titanium) and various kinds of colored pigments can be used. Metal powders of 0.2 to 50 μm average particle diameter such as various kinds of golden powders, silver powders, west golden powder, anti-corrosion west golden powder, yersi, aluminum flakes, chemical foil, SC powder, aluminum powder, pearl powder, AG powder, DAIYOU SHOW, gold-silver mud, YUUKI goldmud, YUUKI mud, electro-conductive silver material, gold silver paste and the like can be used. A mixture of more than two kinds of these fillers can be used.

It is noted that when an emulsion system is used, it is also a merit that discoloration and disappearance of the pigments and fillers can be avoided.

In the case in which pigments and metal micro powders, for example, such as titanium oxide, golden powder and aluminum powder are formulated into a resin layer, 10 to 500 wt parts are mixed for 100 parts by wt of the solid resin. In the case of a light color, it is sufficient that 20 to 100 wt parts are used. In the case of deep colors, it is preferred that 50 to 500 wt parts are used. In each case of the above, the second transfer paper having a white, colored, gold or silver resin layer is produced. In the case of the addition of a gold or aluminum powder, a second sheet having different reflections are formed by mixing different particle sizes or different color tones. The thickness of the upper layer is 5 to 40 mμ, specially preferable is 10 to 25 mμ.

Thus, second transfer sheets of various kinds of colors, white, golden, silver and others, can be manufactured by selecting the kind of pigments and metal micro powders.

The application method and the process using the two transfer sheets of the fourth embodiment of the transfer system to transfer to a glass/transparent plate are nearly the same as those of example (II-2) except that the second transfer sheet includes an acrylic resin (or urethane resin) layer containing a filler as the lower layer and a clear resin layer as the upper layer and the exposed face, by removing the releasing sheet of the first transfer sheet, is adhered to a glass/transparent plate.

In the case in which the object to which an image is to be transferred is a glass plate, the image layer is sandwiched between the resin layer of the first sheet and the clear resin layer of the second sheet, and all of the layers are combined on the glass plate in one body.

In the case of a glass plate, a finished sandwich panel in which the image is held between the glass and a white pigment layer, is useful as a decoration panel having the glass plate as the external wall. Especially, sunlight is diffused when the transparent plate is embossed externally and the decoration plate has a mild appearance as a whole.

Similarly, in a case in which a second transfer sheet having only clear resin layers is used, a decoration panel having an appearance of stained glass is manufactured, in which the picture image is seen emerging to the surface through the passing light.

The third, fourth and fifth embodiments of the transfer system of the present invention and transfer methods employing these systems are further illustrated in the following examples which, however, are not intended to limit the scope of the present invention. The parts and percentages are on a weight basis.

In the examples silicone releasing papers used for manufacturing the transfer sheets are those commercially available and having a weight of 97 g/m$^2$. The back surface of the papers was coated with an acrylic urethane paint [an equivalent mixture of Hitaroid 3012X(acrylic polyol 50% organic solvent solution, Hitachi Kasei) and Duranate 24A-100 (HMDI) biuret type trimer, Asahi Kasei], coating amount: about 20 g/m $^2$, hardening drying: at room temperature for 24 hours.

SYNTHESIS EXAMPLES OF URETHANE RESIN EMULSIONS-1–3 HAVING CARBOXY GROUPS

Synthesis Example 1

Manufacture of urethane resin emulsion (U-1)

In a polymerization vessel, were placed 115.5 parts of polybutylene adipate having a number average molecular weight (na MW) of 2000, 115.5 parts of polycaprolactone diol of na MW 2000, 23.2 parts of dimethylol propionic acid, 6.5 parts of 1,4-butane diol and 120.1 parts of 1-isocyanato-3-isocyanatomethyl-3,5,5-trimethylcyclohexane (IPDI). The components were reacted under a nitrogen atmosphere at 85° C. for 7 hours with stirring, and a prepolymer having 4.0% of NCO groups as terminal NCO groups was obtained. Then, the prepolymer was cooled to 50° C., and, after 165 parts of acetone were added and the prepolymer dissolved uniformly, 15.7 g of triethylamine were added with stirring, and then 600 parts of ion exchanged water were added keeping the temperature lower than 50° C. The thus obtained dispersion in water was kept at 50° C. for 2 hrs, and after the water extension reaction was completed, the acetone was distilled off at a temperature lower than 70° C. under reduced pressure. 944 parts of a urethane resin emulsion (U-1) having 2.05% carboxyl group per resin and 42.0% solids were obtained.

Synthesis Example 2

Manufacture of urethane resin emulsion (U-2)

In a pressure-proof polymerization vessel were placed 115.5 parts of polypropyleneglycol of na MW 2100, 115.5 parts of polytetramethyleneetherglycol of na MW 2000, 23.2 parts of dimethylol propionic acid, 6.7 parts of trimethylolpropane, 141.7 parts of 4,4'-dicyclohexylmethane diisocyanate and 174 parts of acetone. After nitrogen gas was replaced in the reaction system, reaction was carried out at 85° C. for 5 hrs. An acetone solution of a prepolymer having terminal NCO groups (NCO content: 2.6%) was obtained. Next, in a similar manner to Synthesis Example 1, 1045 parts of urethane resin emulsion (U-2) having 1.94% carboxyl groups per resin and 40.1% solid was obtained.

Synthesis Example 3

Manufacture of urethane resin emulsion (U-3)

In a polymerization vessel were placed 115.5. parts of polycaprolactone diol having a na MW of 2050, 115.5 parts of polyneopentyl/hexyl adipate having a na MW of 2450, 9.9 parts of 1,6-hexane diol and 141.7 parts of 4,4'-dicyclohexylmethanediisocyanate. These components were reacted in a nitrogen atmosphere at 110° C. for 3 hrs., and then 23.2 parts of dimethyl propionic acid were added, and the system was further reacted for 3 hrs at the same temperature. A prepolymer having 3.7% NCO groups was obtained. Into the prepolymer 176 parts of acetone were added to dissolve it uniformly. The above acetone solution of the prepolymer was added with high speed stirring into 640 parts of water containing 16.7 parts of triethylamine in another vessel. The resultant system was treated in the same way as in Example 1, and 1018 parts of urethane resin emulsion (U-3) having 1.92% carboxyl groups and 41.5% solids was obtained.

In the following examples, the following are used as abbreviations and explanations of raw materials of the coating solutions for the manufacture of the transfer sheets:

AP-20: Hydran AP-20 (resin 30%), AP-70: Hydran AP-70 (resin 35%), APX-110: Hydran AP-110 (resin 35%): Non-yellowing urethane emulsions useful in the present invention having COOH groups (about 1 to 2% for the resin) and products of Dai-nippon Ink & Chemical Inc.

85 UD is an abbreviation of Impranel Dispersion 85 UD, a product of Bayer, and is a non-yellowing urethane emulsion having COOH groups useful in the present invention.

V, CG and AB are abbreviations of Voncoat V, CG-5030 and AB 782, acrylic emulsions of 29, 50, 45% non-volatile solids, respectively, manufactured by Dai-nippon Ink & Chemical Inc.

Silane-coupling agent is γ-glycidoxypropyltrimethoxysilane.

LO is Cover Coat resin LO 316 (polymethacrylate alkyl 33% solvent naphtha solution, produced by Goou Chemical Ind. Co., Ltd.).

N is an abbreviation of 25% ammonia.

VE is an abbreviation of a viscosity/elasticity adjuster.

UV is an abbreviation of a UV absorber.

A is an abbreviation of an antioxidant.

T is an abbreviation of triethanolamine.

E is an abbreviation of an electro-static agent.

L is an abbreviation of an epoxy cross linker.

F is an abbreviation of a leveling agent.

H is a light-stabilizer of a hindered amine type.

Figures in parentheses are added amounts in terms of weight.

The silica and titanium oxide used in the examples had an average particle diameter of 3.1 to 3.3 μm and 0.3 to 0.5 μm, respectively.

The following are preparations and formulations for the coating solutions for the transfer sheets of the present invention.

Formulation of coating solution (1) (The layer of the first sheet for glass)

AP-20 (80), AP-70 (20), silica micro-powder (3), silicone defoamer (1), V (0.5), N (0.5), VE (0.5), UV (0.5), silane-coupling agent (0.5), A (0.5), E (0.5), T (2), F (0.5), H (0.5).

Formulation of coating solution (2) (The upper layer of the second sheet for glass)

AP-20 (80), AP-70 (20), silica micro-powder (3), silicone defoamer (1), V (0.5), N (0.5), VE (0.5), F (0.5).

Formulation of coating solution (3) (The lower layer of the second sheet for glass)

APX-110 (70), titanium oxide micro-powder (60), V (1), N (0.5), VE (0.5), CG (30), L (1), ethyleneglycol (2.0), F (0.5), water (10).

Using the coating solution (3) as the lower layer, and the coating solution (2) as the upper layer, a second white transfer sheet for glass was prepared. The paper is used in combination with the first transfer sheet in the same way as in the case of a transparent type.

Formulation of coating solution (4) (The layer of the first sheet for deep colored clothes)

85UD (400), silica micro-powder (8), silicone defoamer (4), VE (5), T (8), F (2).

Formulation of coating solution (5) (The upper layer of the second sheet for deep colored clothes)

85UD (200), silica micro-powder (3), silicone defoamer (2), VE (2), golden powder (40) or silver powder (20), F (1).

Formulation of coating solution (6) (The lower layer of the second sheet for deep colored clothes)

AP-20 (30), AP-70 (70), silica micro-powder (3), silicone defoamer (1), VE (1.25), F (0.5).

Formulation of coating solution (7) (The layer of the first sheet for hand-drawings for clothes)

AP-20 (70), AP-70 (30), silica micro-powder (3), silicone defoamer (1), N (1), VE (0.5), F (0.5), V (0.5).

Formulation of coating solution (8) (The upper layer of the second sheet for hand-drawings for clothes)

AP-20 (60), AP-70 (40), V (0.5), silica micro-powder (3), silicone defoamer (1), VE (0.5), N (1), golden powder (20) or silver powder (10), F (0.5).

Formulation of coating solution (9) (The lower layer of the second sheet for hand-drawings for clothes)

AP-20 (60), AP-70 (40), silica micro-powder (3), V (0.5), silicone defoamer (1), VE (0.5), N (0.5), F (0.5).

Formulation of coating solution (10) (The upper layer of the first sheet for cars)

AP-20 (80), AP-70 (20), silica micro-powder (3), V (0.5), silicone defoamer (1), N (0.5), VE (0.5), UV (0.5), silane-coupling agent (0.5), A (0.5), E (0.5), T (2), F (0.5), H (0.5).

Formulation of coating solution (11) (The lower layer of the first sheet for cars)

LO (100), silica micro-powder (2), silicone defoamer (1), toluene (10), F (0.5), H (0.5), UV (0.5).

Formulation of coating solution (12) (The lower layer of the second sheet for cars)

CG (70), AB (30), silica micro-powder (3), silicone defoamer (1), VE (0.5), N (0.5), F (0.5), V (0.5), UV (0.5), H (0.5).

The second transfer sheet for transferring an image to a car was manufactured using coating solution (12) as the lower layer and coating solution (2) as the upper layer.

According to the above formulations, each of the components was measured and stirred to form the respective coating solutions.

Manufacture of the transfer sheet of the present invention

Each of the above coating solutions was coated on the silicone releasing paper using a silk screen printing machine, and was dried at 100±10° C. for 10 minutes. As to the two-layer coating of the upper and lower layers, at first, the lower layer was coated and dried, and then, the upper layer was coated and dried. Thus, the transfer sheet for the respective uses was manufactured.

Determination of physical properties of the transfer sheet of the invention:

(1) Determination of surface intrinsic electric resistance ratio of transfer layer (a) First transfer sheet for glass Determination conditions: The above transfer sheet was manufactured from the above coating solution containing triethanolamine, and for comparison a transfer sheet was manufactured from a corresponding coating solution not containing triethanolamine. The sheets were conditioned at 20° C., 65% RH, for 24 hrs, and the surface intrinsic electric resistance ratios of the transfer layer of the paper were determined under identical conditions by using an "Isolation Resistance Determination Box TR 42" made by Advantest Inc.

Determination results: The surface intrinsic electric resistance ratios of transfer layers of transfer sheets made from the coating solutions containing triethanolamine were on the level of $10^{11}$, on the other hand those made from solutions not containing triethanolamine were on the level of $10^{12}$ to $10^{13}$, though there were some dispersions. As to a transfer paper coated with the coating solution containing tetrakis (2-hydroxypropyl) ethylenediamine in place of triethanolamine, nearly similar results were obtained.

It was found from these experimental results that the hydroxyalkylamines function as an excellent electric conductor.

(b) Determination of curling of transfer sheet

Coating of resin paint on the back surface: Into 100 parts of Hitaroid 3012X (acrylpolyl 50% organic solvent solution by Hitachi Kasei), 20 parts of Duranate 24A-100 (biuret trimer of hexamethylenediisocyanate by Asahi Chemical) were added and mixed uniformly, and the mixture was coated on the back surface of a transfer sheet.

Determination conditions and method: After a transfer sheet of 29.7 cm×21.0 cm size (A-4 size in Japan) was allowed to stand at 30° C. and 85% RH for 5 minutes, the paper was placed on a horizontal plastic plate so that the face of the silicone layer and the transfer layer faced upwards, and the height of the curl of the paper edge was determined.

Determination results: All of the curl heights of the transfer sheets (the first and the second sheets for glass, the first and the second sheets for deep colored clothes and the first and the second sheets for hand-drawings on clothes) was lower than 5 mm. On the other hand, a curl height of a non-back coated transfer paper could not be determined because the upper surface was rolled in.

From these results, a coating of an acrylic urethane on the back surface was found to be very useful for the prevention of curling.

Examples of Transfer to Glasses, Deep Colored Clothes (Electro-copy and Hand Drawings), Car Bodies and Tiles are Mentioned in Order Transfer Example 1 (glass-1)

A figure image layer was formed by means of a photocopy machine on the first transfer sheet for glass, and the sheet was placed face-to-face with the white second transfer sheet for glass, and stacked. Then, they were heat-pressed to form one body at 180° C. by using a laminator. On the other hand, a sheet of tempered glass (transparent) was readied. The releasing sheet of the first transfer sheet was removed from the unitary body formed from the first and second transfer sheets, and the exposed surface was placed onto the back surface of the glass plate in a face-to-face relationship. They were then heat-pressed by a heat-press machine. After cooling, the releasing sheet of the second transfer sheet was removed. The picture image of the resulting decoration glass panel was seen emerging to the surface on a white background when the image was viewed from the embossed surface.

Transfer Example 2 (glass-2)

In a similar manner to Transfer Example 1, but using the second transfer sheet of the transparent type, a decoration glass panel like stained glass was obtained. It was a merit to be seen stereoscopically from the embossed surface.

Transfer Example 3 (deep colored clothes, color-copy)

A figure image layer was formed by means of a electro photo machine on the first transfer sheet for deep colored clothes, and the sheet was contacted with the golden second transfer sheet having two layers for deep-colored clothes in a face-to-face relationship, and layered. Then, they were heat-pressed by using a heat-press machine. Then, the releasing sheet of the second transfer sheet was removed. The exposed surface was put together on a deep colored T-shirt, and was heat-pressed with the heat-press machine. After cooling, the releasing sheet of the first transfer sheet was removed, and the T-shirt having a design in which a clear picture image emerged to the surface and the toner was not submerged or buried in the resin layer was produced.

Transfer Example 4 (hand-drawings on clothes)

A picture was drawn with crayons on the second transfer sheet (silver background) for hand-drawings, and placed together with the first transfer sheet for hand-drawings, stacked and heat-pressed by using an iron. Next, the releasing sheet of the second transfer sheet was removed, and the exposed face was placed on a deep colored apron. Then, they were heat-pressed with an iron. After the releasing sheet of the first transfer sheet was removed, the apron having a hand-drawing on a silver background of deep-colored cloth was completed.

Transfer Example 5 (car body)

A picture toner layer was formed on the first transfer sheet for car by means of an electro-photo machine, and placed together with the silver second transfer sheet for hand-drawings on clothes, layered and heat-pressed by using a laminator. The coated metal surface was preheated beforehand to about 80° C. with extreme infrared radiation and the surface was wetted with 0.3% solution of a detergent, and to this surface, the exposed surface of the second transfer sheet from which the releasing sheet was removed was attached. Then the trapped air was eliminated with a spatula, and the body was heated with extreme infrared radiation. After cooling, the releasing sheet of the first transfer sheet was removed and heated again with extreme infrared radiation until the resin was melted. After cooling, the transfer to the car body was completed. In this case, the picture image was seen emerging to the surface on a silver background of the original deep-colored car body.

In a similar manner, a picture toner layer was formed on the first transfer sheet for glass by means of an electro-photo machine, and placed together with the second (transparent lower layer) transfer sheet for cars. And, in the same manner as above, transfer was completed on a white car body. A transferred body having an acrylic resin as a surface excellent in water resistance was obtained.

A nearly similar result was obtained, in the case of using the second transfer sheet for cars in place of the first transfer sheet for cars.

Transfer Example 6 (tile)

A toner image layer was formed on the first transfer sheet for glass by means of electrostatic copying, and a commercial ceramic tile was preheated beforehand so that the surface temperature was about 80° C. The surface of the image toner layer was placed on the tile, and was pressed using a heat-press machine. Then, the image layer was transferred to the tile surface. After cooling, the releasing sheet was removed, and the tile was heated again in an atmosphere higher than about 100° C. higher than the softening point of the resin. A beautiful tile having a gloss was obtained. In the case of the use of the first transfer sheet for cars as the second transfer sheet, a transfer having a waterproof acrylic resin layer as the external layer was obtained.

When the above Transfer Examples (1 to 6) were repeated using urethane resin emulsions (U-1 to U-3) having carboxyl groups synthesized in Synthetic Example 1 to 3 in the coating formulations, were essentially similar results to the preceding were obtained.

Comparative Transfer Example 7

Formulation of coating solution (13) (The layer of the f first transfer sheet for glass)

[VONDIC 1640* (100), silica micro-powder (3), silicone defoamer (1), V (0.5), N (0.5), VE (0.5), UV (1.0), silane-coupling agent (0.5), A (0.5), E (0.5), F (0.5), H (0.5)].

Formulation of coating solution (14) (The upper layer of the second transfer sheet for glass)

[VONDIC 1640* (100), silica micro-powder (3), silicone defoamer (1), V (0.5), N (0.5), VE (0.5), F (0.5)].

Formulation of coating solution (15) (The lower layer of the second transfer sheet for glass)

[VONDIC 1640* (100), titanium oxide micro-powder (60), V (1), N (0.5), VE (0.5), F (0.5), ethyleneglycol (2), water (10)].

Note* VONDIC 1640 is a non-yellowing urethane emulsion not having any carboxyl groups, manufactured by Dainippon Ink & Chemical Inc.

According to the above coating formulations, the first transfer sheet and the second transfer sheet of Comparative transfer example 7 were prepared. In a similar manner to Transfer Example 1, decoration glass panels were manufactured.

A piece of adhesive tape was adhered to the decoration glass panel obtained in Comparative Transfer Example 7, and the panel was subjected to a Grid-Tape test (peeling test, JIS K 5400). The results of the tests showed that the transfer layer of the pane of Comparative Transfer Example 7 was completely peeled. On the other hand, no peeling was observed in the decoration panel made in Transfer Example 1, and the adhesion was excellent.

Effect of co-use of organic silicone compounds

In Transfer Example 1, γ-glycidoxypropyltrimethoxysilane was used as a silane coupling agent in the coating solution for the first transfer sheet for glass. on the other hand, for a comparative example, a comparative first transfer sheet for glass was prepared by using the coating solution not containing the silane coupling agent. In a similar manner to Transfer Example 1, combining the sheet with the second transfer sheet for glass, and operating similarly to Transfer Example 1, a transferred glass having a white background was obtained. There was no difference between the glass of Transfer Example 1 and of the comparative example from all appearances. But, with respect to test results in accordance with Grid-Tape method (JIS K 5400), peeling test), there is no change on the test specimen of Transfer Example 1. On the other hand, partial removing is observed on the comparative specimen. From these results, it is found that the silane coupling agent contributes to adhesion between the resin and the glass.

Effect of co-use of epoxy and isocyanate cross linking agents

Epoxy cross linking agent: sorbitol tetraglycidyl ether (CR-5L, manufactured by Dai-Nippon Ink and Chemical)

Isocyanate cross linking agent: Trial sample (a reaction product of HMDI isocyanurate trimer and PEG 1000, NCO %: 8.4%)

In the case of the transfer to a glass plate of Transfer Example 2, a second transfer sheet for glass was prepared by using the coating solution of the lower layer of the transfer sheet for glass (containing the epoxy cross linking agent). In the same operation as in Transfer Example 2, a glass plate having a transferred picture was prepared. On the other hand, two glass plates having the picture were prepared in a similar manner from the solution not containing the epoxy cross linking agent and the solution in which the above Trial Sample was used in place of the epoxy cross linking agent. The glass plate of Transfer Example 2 was identified as glass-2, the glass plate from the solution not containing CR-5L was identified as glass -0, and the glass plate from the solution containing the Trial Sample was identified as glass-T. These glass plates were dipped in 1% NaOH aq. solution for 24 hrs and removed. The change of their surfaces was observed by the naked eye. The results were as follows;

Glass-2: no change

Glass-0: partial removing

Glass-T: no change

From these results, it was determined that these cross-linking agents contribute to anti-alkali properties.

Effect of co-use of silica micro-powder

In the formulation of the coating solution for transfer paper (the upper layer of the second transfer sheet for hand-drawings on clothes) containing neither gold powder nor silver powder, 3 weight parts of silica micro-powder based on a total of 100 weight parts of AP-20 and AP-70 was added to one solution, and no silica micro-powder was added to the other solution. These solutions were coated on silicone releasing sheets, and their second transfer sheets were prepared, respectively. On each of these sheets it was attempted to hand-draw by using a crayon. On the second sheet containing silica micro-powder a picture was as easily hand-drawn as on common paper. On the other hand, on the second paper without silica micro-powder, the crayon was liable to slip and not to be drawn properly.

The transfer method of the present invention using transfer systems of the fourth and fifth embodiments of the present invention will now be described with reference to FIGS. 5–7.

Figure 5:
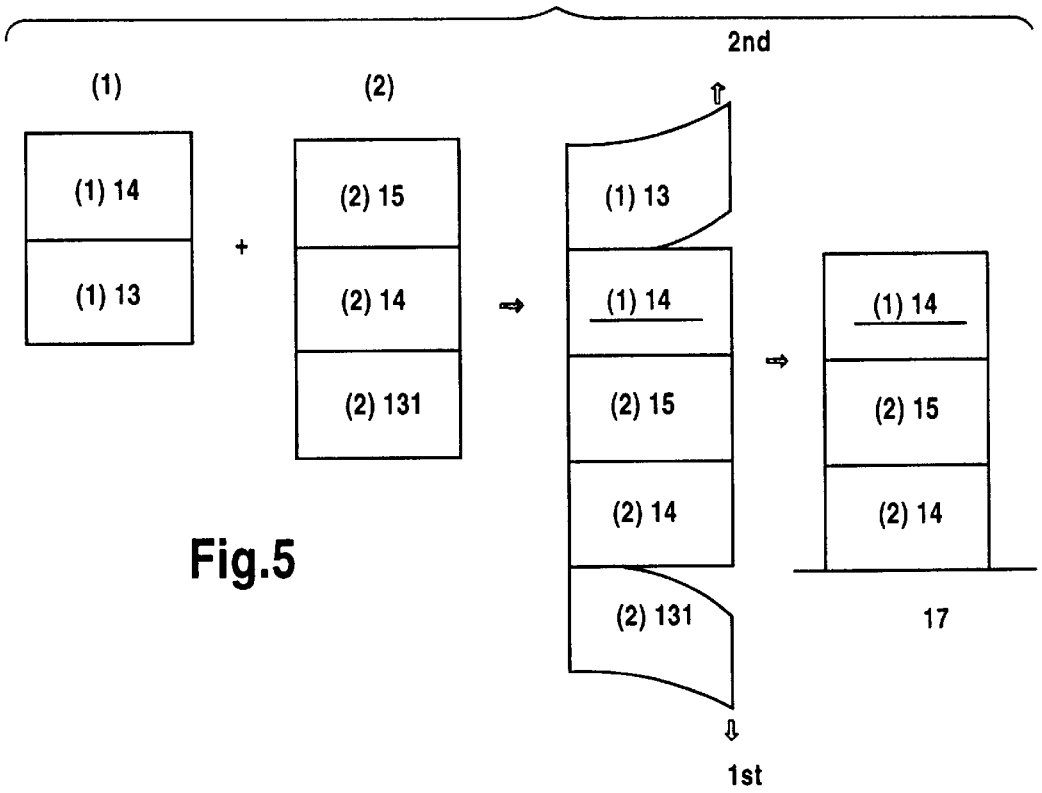
FIGS. 5–7 illustrate embodiments of the transfer method of the present invention employing the fourth and fifth embodiments of the transfer system of the present invention.

Referring to FIG. 5, a first transfer sheet having only a clear resin layer 14 provided on a releasing paper 13, and a second transfer sheet having two layers of an upper filler-containing resin layer 15 and lower clear resin layer 14 on a releasing paper 131 are adhered to form one body, and the releasing paper 131 of the second transfer sheet is removed. The exposed surface is set on the surface of a substrate 17 and adhered by heat-pressing. Then the releasing paper 13 of the first transfer sheet is removed.

Figure 6:
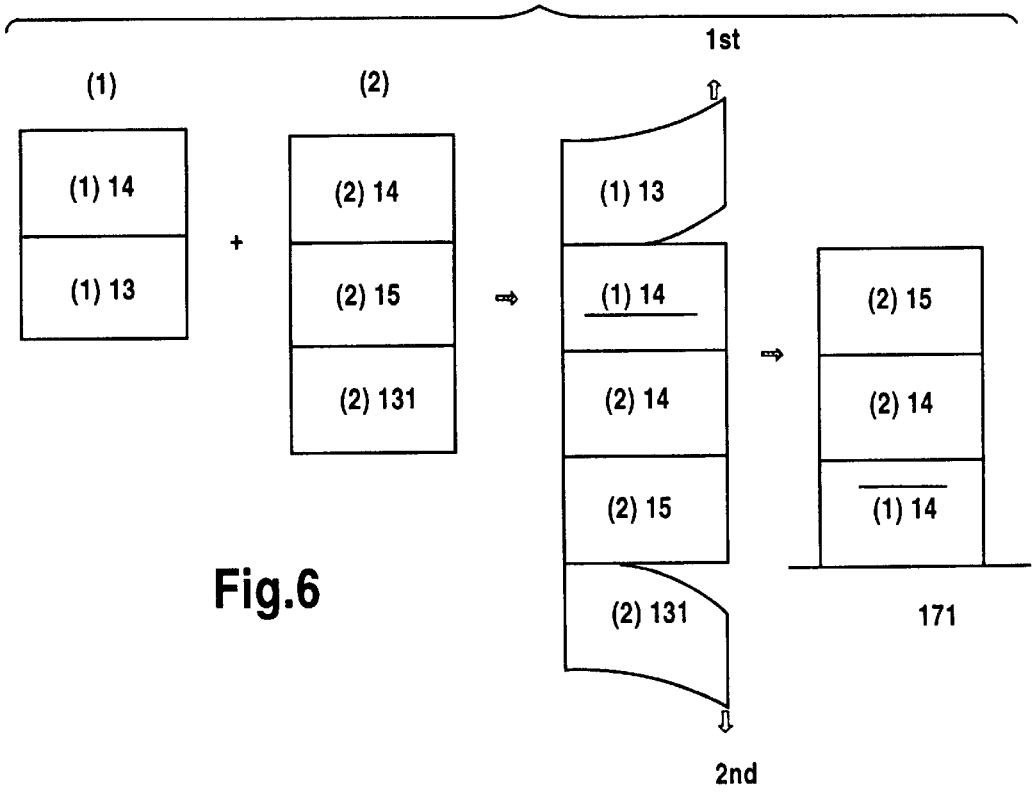

Referring to FIG. 6, a first transfer sheet having only a clear resin layer 14, and a second transfer sheet having two layers of a lower filler-containing resin layer 15 and an upper clear resin layer 14 are adhered to form one body, and the releasing paper 13 of the first transfer sheet is removed. The exposed surface is set on the surface of the substrate 171 and adhered by heat-pressing. Then the releasing paper 131 of the second transfer paper is removed.

Referring to FIG. 7, a first transfer paper having only a clear resin layer 14, and a second transfer paper having two layers of a lower acrylic resin layer 16 and an upper clear resin layer 14 are adhered to form one body, and the releasing paper 13 of the first transfer paper is removed. The exposed surface is set on the surface of the substrate 172 and adhered by heat-pressing. Then the releasing paper 131 of the second transfer paper is removed.

EFFECTS OF THE PRESENT INVENTION

The transfer sheet of the present invention have the following effects:

(1) It is excellent in adhesion because it contains carboxyl groups.

(2) It has low electric conductivity because of the formation of a hydroxyalkylamine salt.

(3) Adhesion and the water-resistance are improved by the combined use with organic silicone compounds and cross-linking agents.

(4) The image layer of a color-copy can be transferred so as to be seen as emerging to the surface on each of various filler layers and, therefore, can be applied to deep-colored clothes.

(5) The picture image when sandwiched between glass and the white filler layer produces a panel excellent as a decoration panel.

EXPLANATION OF NUMERALS IN THE DRAWINGS

A: The first transfer sheet

B: The second transfer sheet

1: Releasing sheet

2: Urethane emulsion resin layer

3: Releasing sheet

4: The lower layer

5: The middle layer

6: The upper layer

7: The picture toner layer

8: The object to be transferred

(1) the first transfer paper

(2) the second transfer paper

13: releasing paper

14: clear resin layer

15: filler-containing resin layer

16: acrylic resin layer

17: substrate (surface)

¯ or _: the insert place of picture tone layer↑ and ↓, first and second: removing direction and order of removal of releasing paper

What is claimed is:

1. A transfer sheet comprising a a releasing substrate and a layer of a urethane resin containing carboxyl groups and/or of an acrylic resin formed on a surface of the releasing substrate, said urethane resin being formed from a self-emulsifiable emulsion obtained by a water extension reaction of a urethane prepolymer after neutralization with a tertiary amine.

2. The transfer sheet of claim 1 wherein said urethane resin and/or said acrylic resin is in the form of a salt of a hydroxylalkylamine of the formula (I)

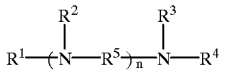

where at least one of $R^1$, $R^2$, $R^3$ and $R^4$ is hydroxyalkyl of $C_2$ to $C_3$, and the others are alkyl, cycloalkyl, hydroxyalkoxyalkyl of $C_1$ to $C_6$; $R^5$ is alkylene of $C_2$ to $C_6$ and n is 0, 1 or 2.

3. The transfer sheet of claim 2 wherein the hydroxyalkylamine is an alkanolamine.

4. The transfer sheet of claim 1 wherein said urethane resin and/or acrylic resin contains an organic silicone compound of the formula $$XCH_2CH_2CH_2Si(R^6)_3$$

where three of $R^6$ are the same or different and are selected from methoxy, ethoxy and methyl and X is glycidylether, amino or β-aminoethylamino.

5. The transfer sheet of claim 4 wherein the organic silicone compound is γ-glycidoxypropyl trimethoxysilane.

6. The transfer sheet of claim 4, wherein the organic silicone compound is N-β-(aminoethyl)-γ-aminopropylmethyl dimethoxysilane.

7. The transfer sheet of claim 1 wherein said urethane resin and/or said acrylic resin is crosslinked.

8. The transfer sheet of claim 7 wherein said urethane resin and/or said acrylic resin is crosslinked by a crosslinking agent selected from the group consisting of an epoxy compound and an isocyanate compound.

9. The transfer sheet of claim 1 wherein the releasing substrate is a paper having a releasing agent on one surface thereof and a non-water soluble polymer resin film on the other surface.

10. The transfer sheet of claim 9 wherein the non-water soluble polymer resin film is an acryl-urethane.

11. The transfer sheet of claim 1 wherein said urethane resin and/or said acrylic resin each contain a ceramic powder in an amount of 1 to 20 wt %.

12. A transfer system comprising a first transfer sheet including a releasing substrate and a layer of a urethane resin containing carboxyl groups and/or of an acrylic resin formed on a surface of the releasing substrate and a second transfer sheet including a releasing substrate, a lower layer of a urethane resin having carboxyl groups and/or of an acrylic resin formed on a surface of the substrate and an upper layer of a urethane resin having carboxyl groups and/or of an acrylic resin formed on the lower layer, said lower and upper layers having different properties.

13. The transfer system of claim 12 wherein one of said lower and upper layers contains an organic or inorganic filler.

14. The transfer system of claim 12 wherein one or more of the urethane resins is formed from a self-emulsifiable emulsion obtained by a water extension reaction of a urethane prepolymer after neutralization with a tertiary amine.

15. The transfer system of claim 14 wherein at least one of the urethane resins and/or the acrylic resins is in the form of a salt of a hydroxylalkylamine of the formula (I)

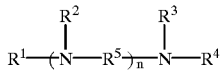

where at least one of $R^1$, $R^2$, $R^3$ and $R^4$ is hydroxyalkyl of $C_2$ to $C_3$, and the others are alkyl, cycloalkyl, hydroxyalkoxyalkyl of $C_1$ to $C_6$; $R^5$ is alkylene of $C_2$ to $C_6$ and n is 0, 1 or 2.

16. The transfer system of claim 15 wherein the hydroxyalkylamine is an alkanolamine.

17. The transfer sheet of claim 12 wherein at least one of the urethane resins and/or acrylic resins contains an organic silicone compound of the formula $$XCH_2CH_2CH_2Si(R^6)_3$$

where three of $R^6$ are the same or different and are selected from methoxy, ethoxy and methyl and X is glycidylether, amino or β-aminoethylamino.

18. The transfer system of claim 17 wherein the organic silicone compound is γ-glycidoxypropyl trimethoxysilane.

19. The transfer system of claim 17, wherein the organic silicone compound is N-β-(aminoethyl)-γ-aminopropylmethyl dimethoxysilane.

20. The transfer system of claim 12 at least one of the urethane resins and/or acrylic resins is crosslinked.

21. The transfer system of claim 20 wherein at least one of the urethane resins and/or acrylic resins is crosslinked by a crosslinking agent selected from the group consisting of an epoxy compound and an isocyanate compound.

22. The transfer system of claim 12 wherein each releasing substrate is a paper having a releasing agent on one surface thereof and a non-water soluble polymer resin film on the other surface.

23. The transfer system of claim 22 wherein the non-water soluble polymer resin film is an acryl-urethane.

24. The transfer system of claim 12 wherein at least one of the urethane resins and/or acrylic resins contains a ceramic powder in an amount of 1 to 20 wt %.

* * * * *